US008584848B1

(12) United States Patent
Lee et al.

(10) Patent No.: US 8,584,848 B1
(45) Date of Patent: Nov. 19, 2013

(54) RAZOR CARTRIDGE DISPENSER

(71) Applicant: ADKM Inc., New York, NY (US)

(72) Inventors: Stuart Harvey Lee, Forest Hills, NY (US); Jochen Rainer Schaepers, New York, NY (US); Andy Katz-Mayfield, Santa Monica, CA (US); Jeffrey Jacob Raider, New York, NY (US)

(73) Assignee: ADKM, Inc., New York, NY (US)

( * ) Notice: Subject to any disclaimer, the term of this patent is extended or adjusted under 35 U.S.C. 154(b) by 0 days.

(21) Appl. No.: 13/788,299

(22) Filed: Mar. 7, 2013

(51) Int. Cl.
*B65D 83/10* (2006.01)

(52) U.S. Cl.
USPC ..... 206/354; 206/356; 206/353; 206/477; 30/40

(58) Field of Classification Search
USPC ..... 206/356, 355, 354, 357, 358, 359, 360, 206/352, 353, 477; 30/40, 41, 40.2; D9/749, 748, 736
See application file for complete search history.

(56) References Cited

U.S. PATENT DOCUMENTS

| | | | | | |
|---|---|---|---|---|---|
| 1,309,169 | A * | 7/1919 | Young | 206/353 |
| 3,771,223 | A * | 11/1973 | Dawidowicz et al. | 30/40 |
| 3,797,657 | A * | 3/1974 | Petrillo | 206/356 |
| 3,854,201 | A * | 12/1974 | Dawidowicz et al. | 30/40.2 |
| 3,879,844 | A * | 4/1975 | Griffiths | 30/41.7 |
| 3,941,244 | A * | 3/1976 | Braginetz | 206/360 |
| 4,173,285 | A * | 11/1979 | Kiraly et al. | 206/356 |
| 4,742,909 | A * | 5/1988 | Apprille et al. | 206/356 |
| D316,962 | S * | 5/1991 | Gray | D9/736 |
| 5,518,114 | A * | 5/1996 | Kohring et al. | 206/352 |
| 5,636,442 | A * | 6/1997 | Wain | 30/40.2 |
| 6,041,926 | A * | 3/2000 | Petricca et al. | 206/356 |
| 6,052,903 | A * | 4/2000 | Metcalf et al. | 30/40.2 |
| 6,070,724 | A * | 6/2000 | McCool | 206/352 |
| D531,518 | S * | 11/2006 | Ramm et al. | D9/749 |
| 7,413,078 | B2 * | 8/2008 | Fischer et al. | 206/354 |
| 2008/0201957 | A1 * | 8/2008 | Apprille | 30/124 |
| 2011/0139648 | A1 * | 6/2011 | Sonnenberg | 206/354 |

* cited by examiner

*Primary Examiner* — Steven A. Reynolds
(74) *Attorney, Agent, or Firm* — Florek & Endres PLLC

(57) ABSTRACT

A razor cartridge dispenser including a unitarily molded member having compartments in horizontal sequence and a reopenable package member covering the molded member. The individual compartments include a blade portion cavity, a connection portion cavity and a cammed latch on a flexible arm. The blade portion cavity has an upper opening, bottom, top and front walls, a closed side wall and an open side wall. The top and bottom walls are substantially parallel, with the front wall at a right angle thereto, and extend in the direction of the upper opening at an angle to the horizontal disposition of the compartments. The connection portion cavity has top and bottom openings, forward and rearward walls, a closed side wall and an open side wall, where the bottom opening cooperates with the upper opening of the blade portion cavity. The package member includes a reclosable flap to access the compartments.

14 Claims, 6 Drawing Sheets

RAZOR CARTRIDGE DISPENSER

FIELD OF THE INVENTION

The present invention relates to the field of shaving razor dispensers and more particularly to the field of multiple razor cartridge dispensers for dispensing unused razor cartridges and retaining used razor cartridges.

BACKGROUND OF THE INVENTION

Shaving razors have evolved over the years from a straight edge razor, having a razor edge that needed to be sharpened from time to time, to a safety razor having a unitary handle and head, the head being opened to receive replaceable blades, to a handle and razor cartridge system, where a razor cartridge having integrated blades further included a connection mechanism to attach the cartridge to a handle.

With the advent of replaceable blades, there next came the need to keep a store of razor blades for replacement when used blades lost their edge. With safety razors, which used substantially flat single or double edge blades, new blades were individually wrapped in paper, stacked and placed in a cardboard box with end flaps for removing a wrapped blade. The flat nature of the safety razor blades made wrapping in paper and storage of a number of wrapped blades in a small cardboard box very easy.

However, once disposable razor blade cartridges came into use, there was a need to store the blade cartridges in a dispenser where the cartridge could be attached to or removed from the handle quickly and easily. These dispensers were most often formed of plastic and provided separate compartments for individual blade cartridges.

One example of a cartridge dispenser is found in U.S. Pat. No. 3,835,532, which shows a number of compartments into which individual blade cartridges are stored, having latches to maintain the cartridges in the compartments. When a blade cartridge is to be used from the dispenser, the user attaches the handle to the blade cartridge and pulls up on the handle to overcome the force of the latch on the blade cartridge, releasing the blade cartridge from the dispenser. The user can replace a used cartridge into the dispenser by pushing the used blade cartridge into an empty compartment, overcoming the force of the latch when pushing down, and then releasing the cartridge from the handle.

Blade cartridge dispensers have changed with changes in blade cartridges. For example, blade cartridges have changed to include not just the blade portion but also a connection portion that is pivotably attached to the blade portion. In keeping, the dispensers have been designed to include an area for the connection portion of the cartridge.

As shown in U.S. Pat. No. 6,041,926, blade cartridge dispensers have been described to include two piece structures that form compartments for containing the connection portions as well as the blade portions of the cartridge. The structure shown in U.S. Pat. No. 6,041,926 also describes a latch that engages the top of the connection portion of the cartridge, with a cam on the handle to unlatch the connection portion and remove the cartridge.

However, there is needed a razor cartridge dispenser which simply and stylishly retains, dispenses and accepts razor cartridges that is easily made and contains its own packaging.

SUMMARY OF THE INVENTION

The present invention is directed to a razor cartridge dispenser for retaining and dispensing razor cartridges having a blade portion pivotably mounted to a connection portion, the connection portion including a mechanism for connecting the razor cartridge to a handle, the dispenser comprising:

a. a unitarily molded member for retaining, dispensing and accepting a plurality of individual razor cartridges, the molded member comprising a compartment for each of the individual razor cartridges in sequence, with each compartment comprising:

i. a blade portion cavity having an upper opening, a bottom wall, a top wall, a front wall, a closed side wall and an open side wall, wherein the top wall and bottom wall are substantially parallel to each other and the front wall is at a substantially right angle to the top and bottom walls and wherein a centerline between the parallel top and bottom walls in the direction of the upper opening is at an angle to the sequence of compartments;

ii. a connection portion cavity having a top opening, a bottom opening, a forward wall, a rearward wall, a closed side wall and an open side wall, the bottom opening of the connection portion cavity cooperating with the upper opening of the blade portion cavity;

iii. a cammed latch on a flexible arm for engaging the blade portion of the razor cartridge, said cammed latch and flexible arm forming a portion of the top wall of the blade portion cavity; and b. a package member providing a covering for the molded member, the package member comprising a reclosable flap for providing access to the razor cartridges in the compartments of the molded member.

In the preferred embodiment, the flexible arm on which the latch is located extends along the top wall of the blade portion cavity on an axis from the closed side wall to the open side wall, avoiding unintended removal of the cartridges from the compartments. When the cartridge is intended to be removed from the compartment, a handle is connected to a connection portion of the cartridge and the cartridge is slid laterally out of the compartment through the open side walls of the blade portion and connection portion cavities.

Similarly, when a used cartridge is intended to be replaced into an empty compartment, the cartridge is slid laterally into the compartment through the open side walls of the blade portion and connection portion cavities, followed by release of the cartridge from the handle.

The blade portion and connection portion cavities are preferably sized so as to permit entry and removal of the blade cartridges only through the open side walls of the blade portion and connection portion cavities. This may include the use of detents on one or more of the walls of the blade portion cavity and/or connection portion cavity for providing closer tolerances between the dimensions of the cartridge and the dimensions of the compartment as well as ease of insertion and removal of the cartridges into and from the compartments.

To assist the user with the insertion into and removal from the compartments through the open side walls of the blade portion and connection portion cavities, it is preferred that the top opening of the connection portion cavity not extend the full width of the blade portion of the cavity. More specifically, the top opening of the connection portion cavity preferably does not expose the entire width of the blade cartridge when the blade cartridge is fully inserted into the compartment.

The unitary molded member preferably further comprises a left side wall, a right side wall and a rear wall defining an upper perimeter about three sides of the unitarily molded member. It is preferred that the upper perimeter is just sufficient in height to extend above the uppermost elevation of the connection portions of the cartridges in the compartments.

Moreover, the left, right and rear walls preferably form a frame for the package member, ensuring that the connection portions of the cartridges are properly fitted within the package member.

The package member preferably encloses the top, bottom front and back of the molded member with cartridges in the compartments while providing reclosable access thereto. Most preferably the package member is formed of a heavy stock paper or cardboard, however, it can be formed of plastic or coated materials as desired by the designer or manufacturer.

The package flap of the package member preferably includes at least a portion of a back of the package member, a top of the package member and at least a portion of a front of the package member. In its most preferred embodiment, the package flap includes side corners to maintain the top and the at least a portion of the front at a substantially right angle.

In keeping, the razor cartridge dispenser of the present invention preferably provides a package member which can be opened, closed and reopened to insert used blades into or remove new blades from the compartments of a molded member entirely contained within the package member. A catch comprising cooperating catch elements is preferably provided to maintain the dispenser in a closed configuration when desired. When closed, the preferred package member does not show the molded portion or the blade cartridges contained therein.

BRIEF DESCRIPTION OF THE DRAWINGS

The present invention will be better understood when considered in view of the attached drawings, in which like reference characters indicate like parts. The drawings, however, are presented merely to illustrate the preferred embodiment of the invention without limiting the invention in any manner whatsoever.

DETAILED DESCRIPTION OF THE PREFERRED EMBODIMENT

Figure 1:
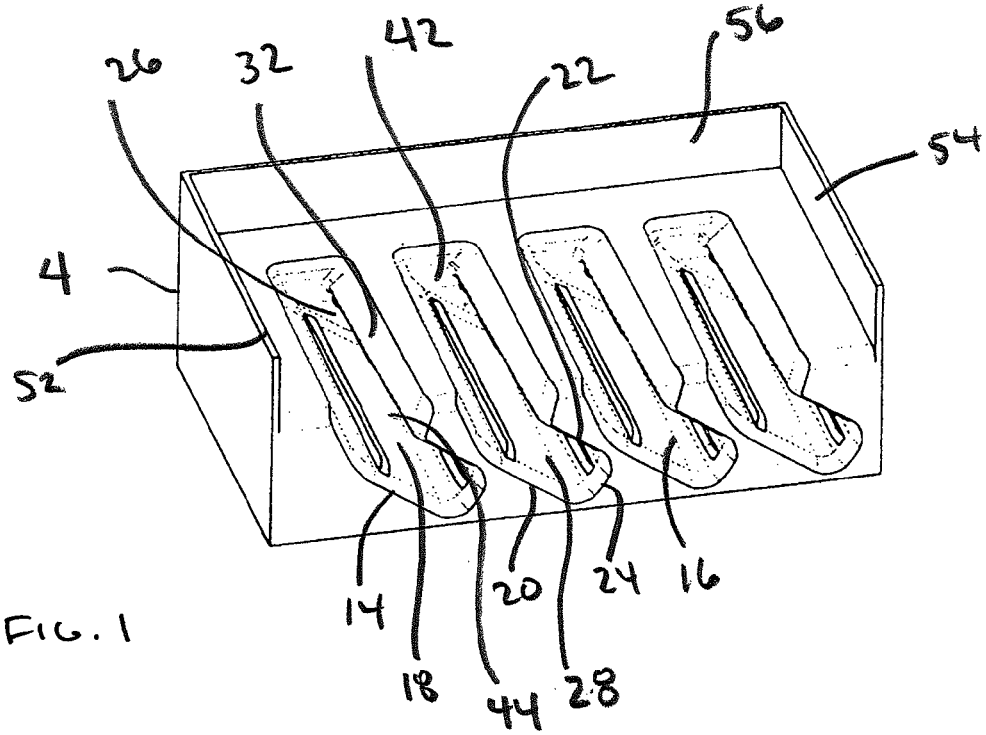
FIG. 1 is a front perspective view of the preferred embodiment of the empty molded member of the razor cartridge dispenser of the present invention.
Figure 2:
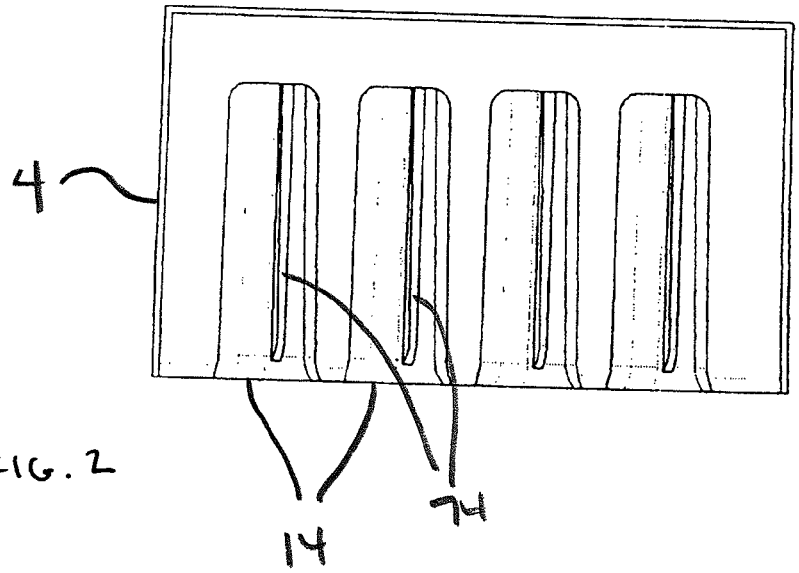
FIG. 2 is a top plan view of the preferred embodiment of the empty molded member of the razor cartridge dispenser of the present invention.
Figure 3:
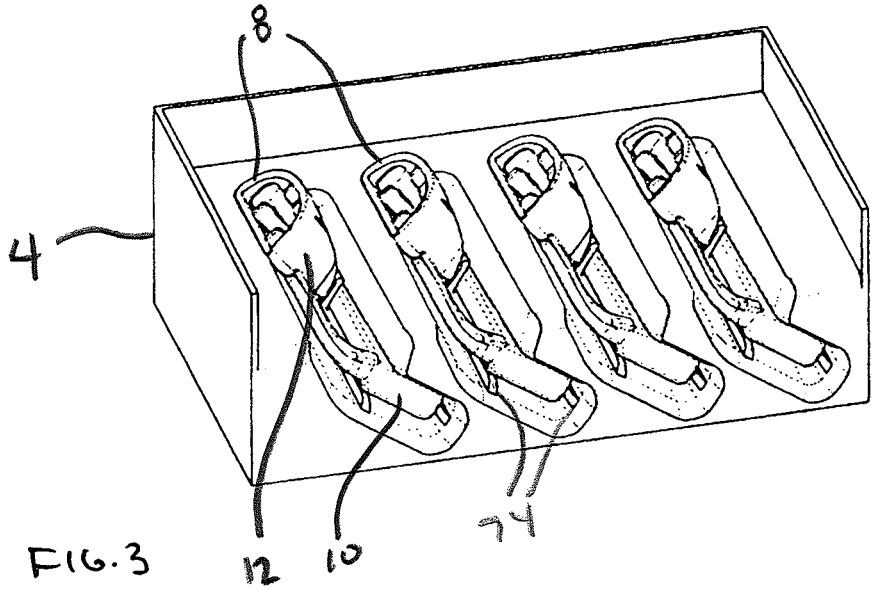
FIG. 3 is a front perspective view of the preferred embodiment of the molded member of the razor cartridge dispenser of the present invention with razor cartridges in the molded member compartments.
Figure 4:
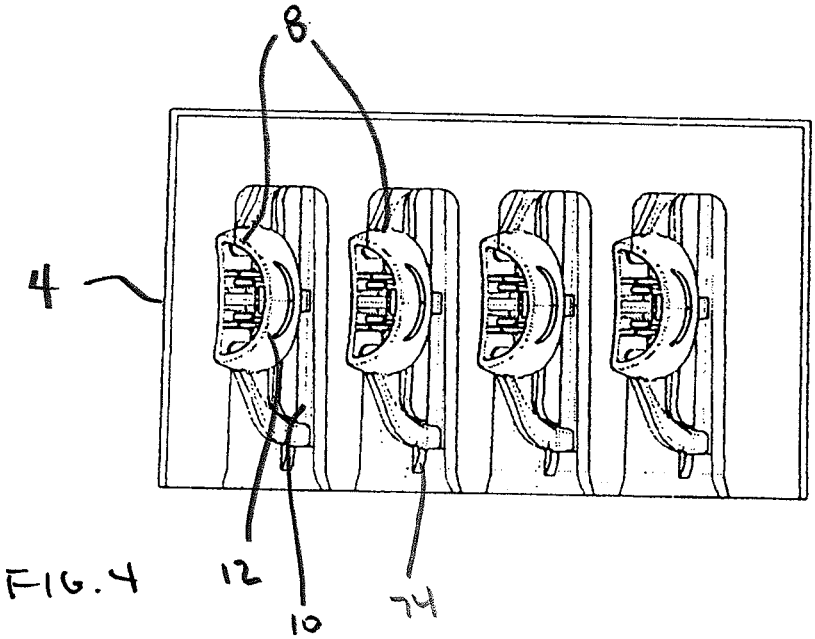
FIG. 4 is a top plan view of the preferred embodiment of the empty molded member of the razor cartridge dispenser of the present invention with razor cartridges in the molded member compartments.

As shown in the drawings, and particularly FIGS. 1, 3, 9, 11 and 12, the present invention is directed to a razor cartridge dispenser 2 comprising a unitarily molded member 4 and a package member 6 for retaining and dispensing razor cartridges 8 having a blade portion 10 pivotably mounted to a connection portion 12, the connection portion including a mechanism for connecting the razor cartridge to a handle (not shown).

The molded member 4 is preferably includes a plurality of compartments 14 for retaining, dispensing and accepting a plurality of individual razor cartridges 8. In the preferred embodiment shown, the plurality of compartments 14 for the individual razor cartridges 8 are formed on the molded member 4 in horizontal sequence. Although any suitable number of compartments 14 can be used, it is preferred that the molded member 4 have between two and six compartments 14, with four compartments being most preferred.

Each of the compartments 14 of the preferred embodiment comprise a blade portion cavity 16 having an upper opening 18, a bottom wall 20, a top wall 22, a front wall 24, a closed side wall 26 and an open side wall 28. The top wall 22 and bottom wall 20 are substantially parallel to each other and the front wall 24 is at a substantially right angle to the top and bottom walls 22, 20. Moreover, as shown in FIG. 6, a centerline 30 between the parallel top and bottom walls 22, 20 extends in the direction of the upper opening 18 at an angle to the sequence of compartments 14.

Figure 6:
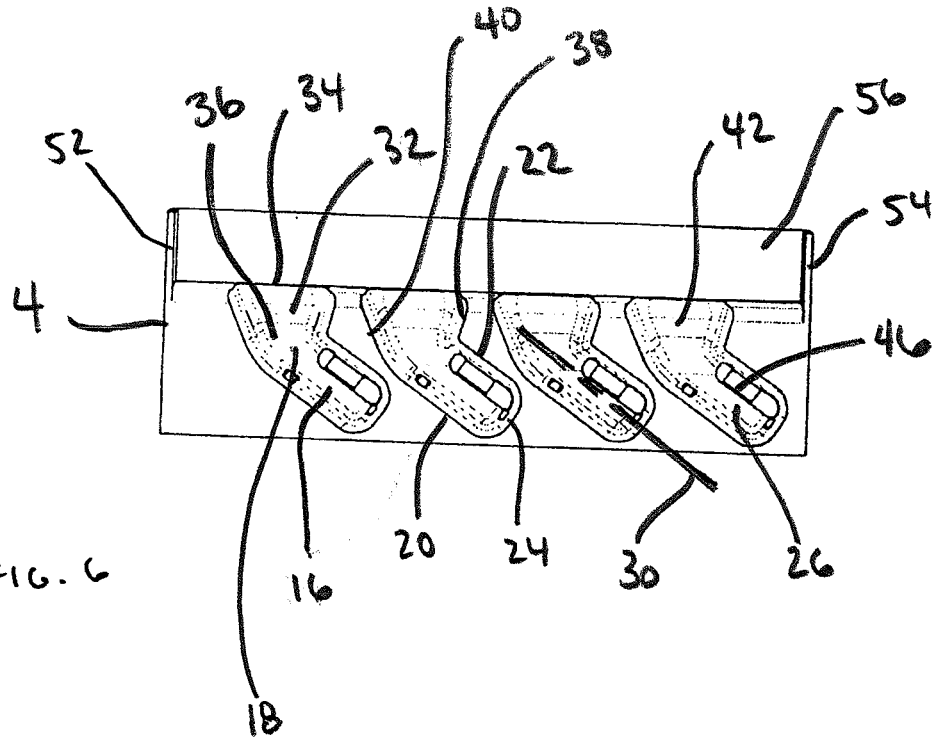
FIG. 6 is a front elevation of the preferred embodiment of the empty molded member of the razor cartridge dispenser of the present invention showing the center line axis between the top and bottom walls of the blade portion cavity.

The compartments 14 each also include a connection portion cavity 32 which is place above and in cooperation with the blade portion cavity 16 (see FIGS. 1 and 6). The connection portion cavity 32 has a top opening 34, a bottom opening 36, a forward wall 38, a rearward wall 40, a closed side wall 42 and an open side wall 44. The bottom opening 36 of the connection portion cavity 32 leads directly to the top opening 18 of the blade portion cavity 16 to create the volume in the cartridge compartment 14 where the majority of the cartridge 8 resides.

Figure 5:
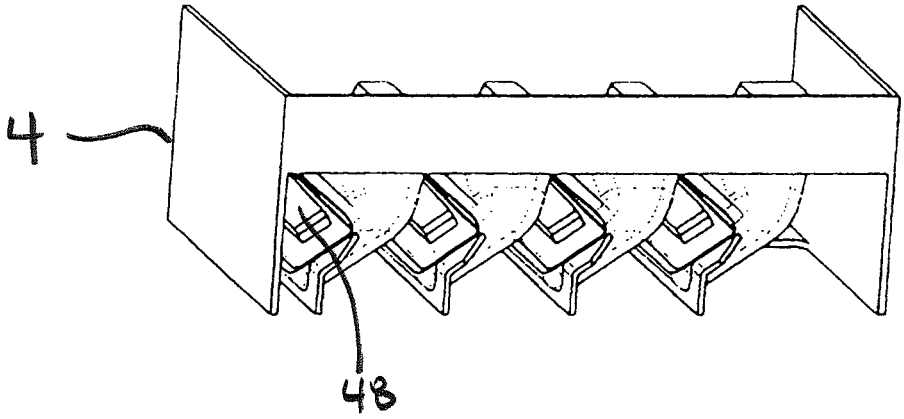
FIG. 5 is a rear perspective view of the preferred embodiment of the empty molded member of the razor cartridge dispenser of the present invention.
Figure 7:
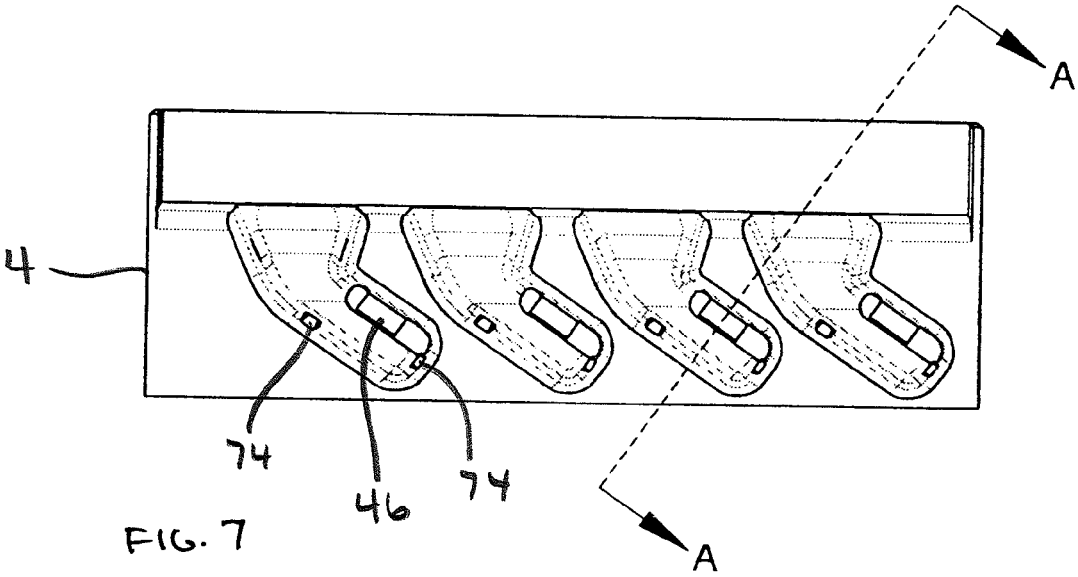
FIG. 7 is a front elevation of the preferred embodiment of the empty molded member of the razor cartridge dispenser of the present invention.
Figure 8:
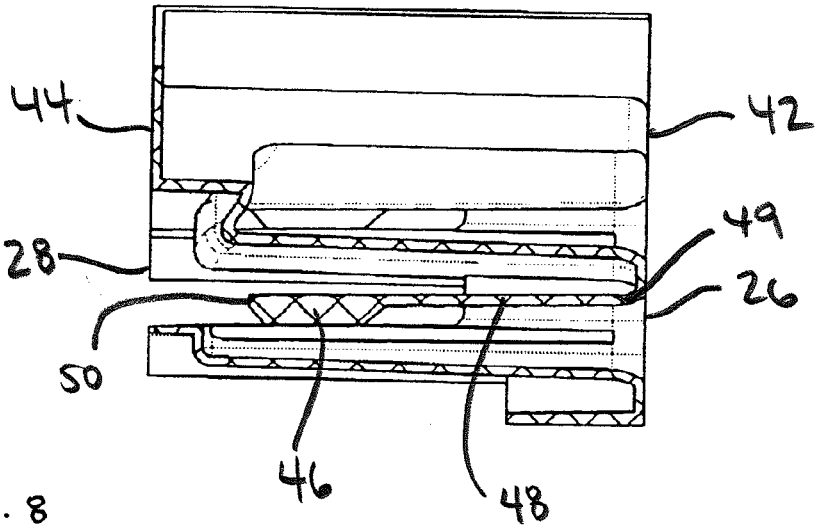
FIG. 8 is a cross section through line A-A of FIG. 7.
Figure 9:
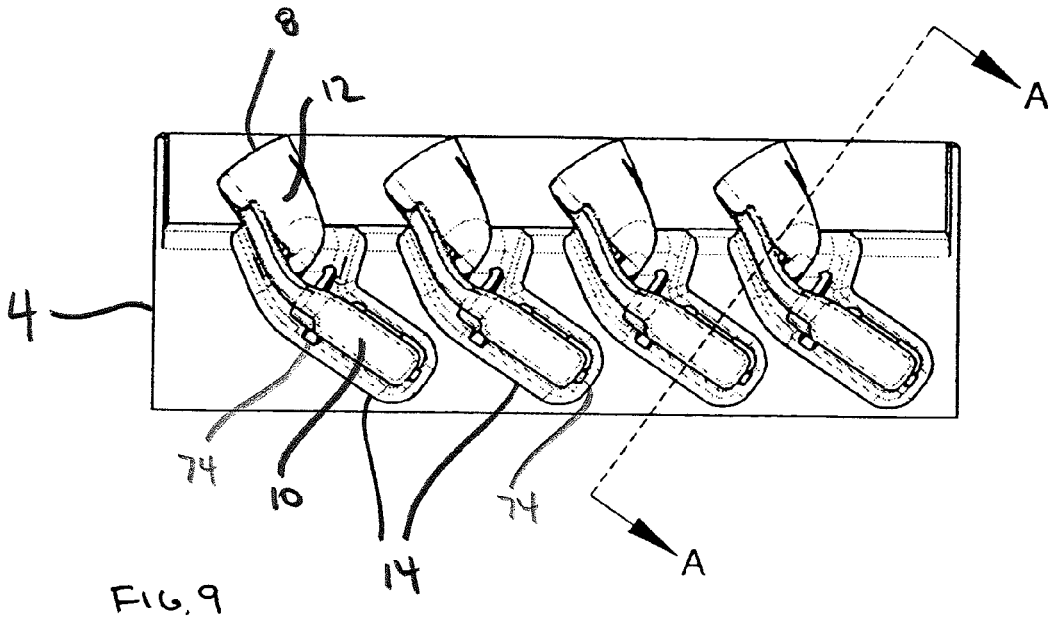
FIG. 9 is a front elevation of the preferred embodiment of the molded member of the razor cartridge dispenser of the present invention with razor cartridges in the molded member compartments.
Figure 10:
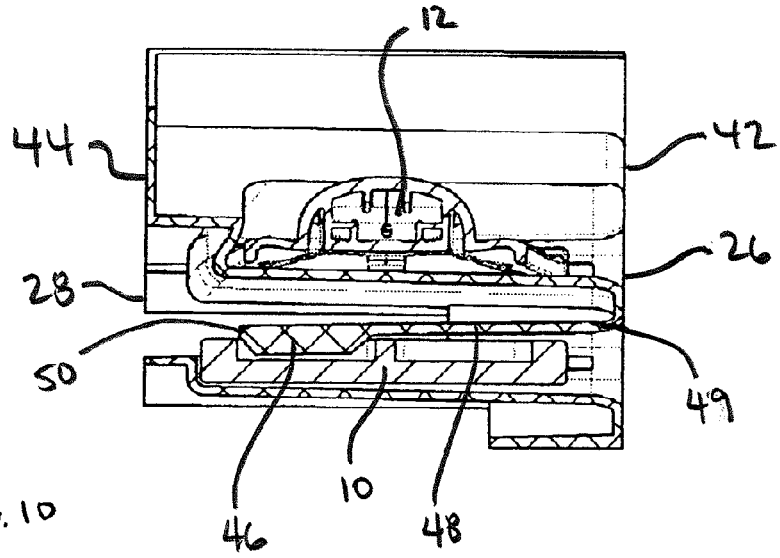
FIG. 10 is a cross section through line A-A of FIG. 9.

As best seen in FIGS. 7 and 8, the preferred compartments 14 further comprise a cammed latch 46 on a flexible arm 48 for engaging the blade portion 10 of the razor cartridge 8 (shown in FIGS. 5, 9 and 10). In the preferred embodiment shown, the cammed latch 46 and flexible arm 48 form a portion of the top wall 22 of the blade portion cavity 16 and extend along the top wall 22. Most preferably, the flexible arm 48 extends from a fixed end 49 at or near the closed side wall 26 of the blade portion cavity 16 to the terminal end 50 of the flexible arm 48, on which the cammed latch 46 resides, in the direction of the open side wall 28 of the blade portion cavity 16 (see FIGS. 8 and 10).

The molded member 4 further comprises a left side wall 52, a right side wall 54 and a rear wall 56 defining an upper perimeter about three sides of the unitarily molded member 4. The left, right and rear walls 52, 54, 56 of the molded member 4 are preferably just of sufficient height to leave headroom for the connection portions 12 of the razor cartridges occupying the cartridge compartments 14. They further provide an upper surface for the package member 6, described below, to rest when the dispenser 2 is in its closed configuration.

Figure 11:
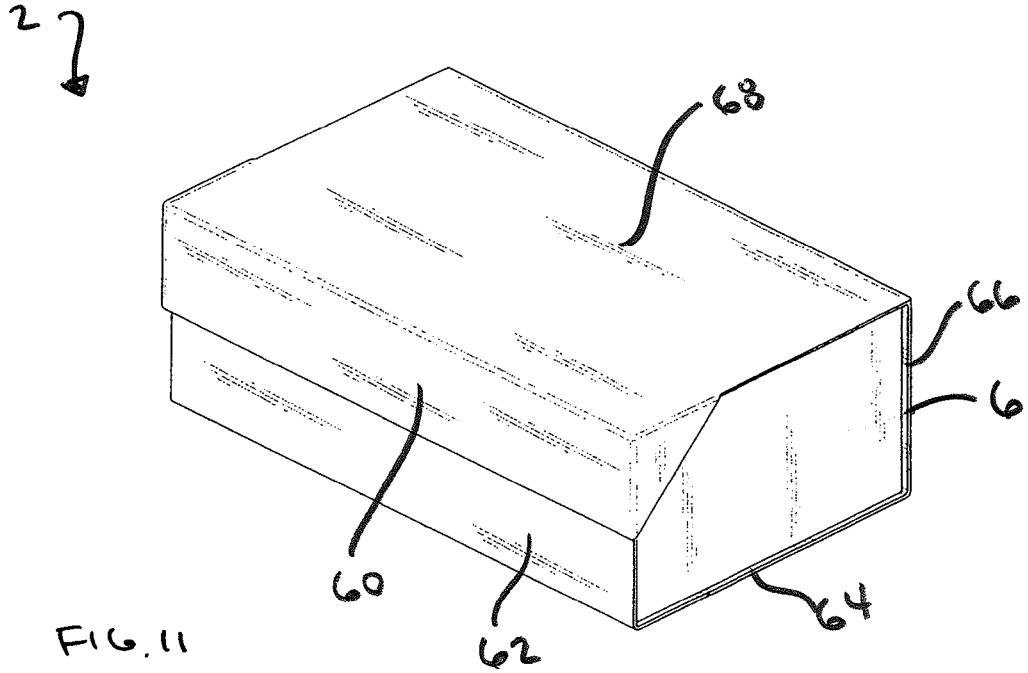
FIG. 11 is a front perspective view of the preferred embodiment of the razor cartridge dispenser of the present invention in its closed configuration.
Figure 12:
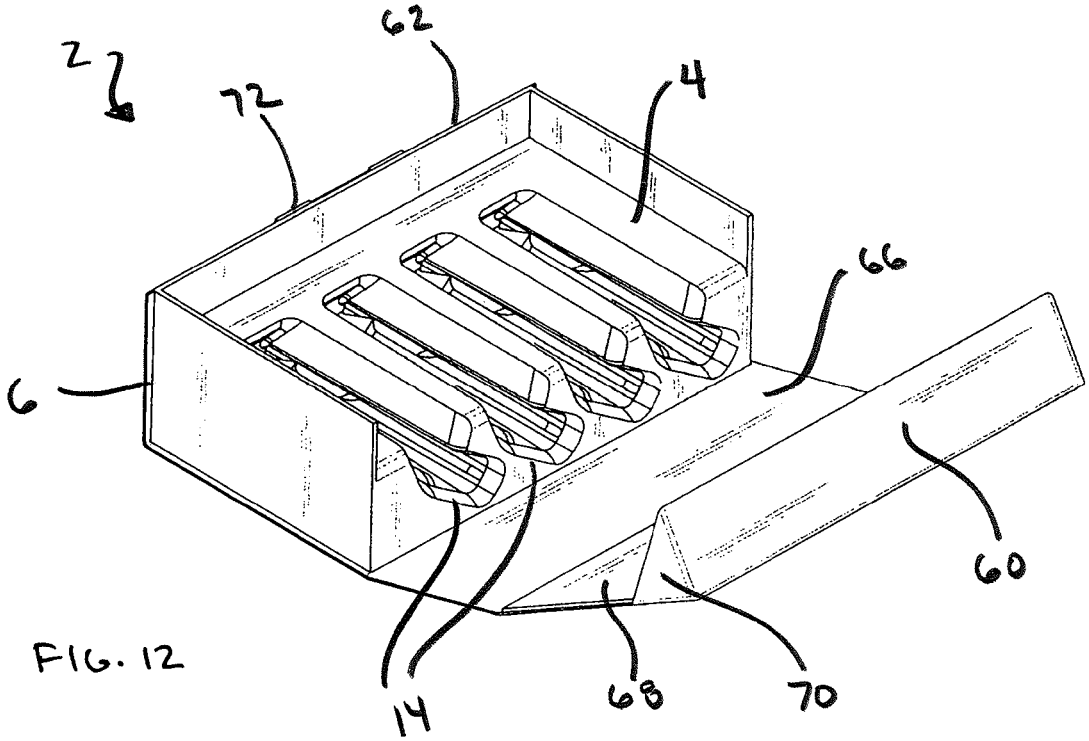
FIG. 12 is a front perspective view of the preferred embodiment of the razor cartridge dispenser of the present invention in its open configuration with the compartments of the molded member empty.

As shown in FIGS. 11 and 12, the preferred package member 6 provides a covering about the front, back, bottom and top of the molded member 4 while leaving the sides of the molded member 4 exposed. In this embodiment, the package member 6 is formed of a single continuous panel terminating in a reclosable flap 60 which can be opened to provide access to the razor cartridges 8 in the compartments 14 of the molded member 4.

The continuous panel forming the package member 6 preferably includes a package front 62 continuing to a package bottom 64, continuing to a package back 66, continuing to a package top 78 and continuing to the terminal flap 60. Most preferably, the package member further comprises flap corners 70 for keeping the flap 60 in a substantially right angle with the package top 68.

The package member 6 of the preferred embodiment also preferably includes a catch 72 for holding the flap 72 in closed relation to the package front 62. The catch preferably comprises cooperating elements, with one of the corresponding elements on the exterior of the package front 62 and the other corresponding element on the inside of the flap 60 so that the catch elements are not visible when the dispenser 2 is in its closed configuration shown in FIG. 11.

The molded member 4 can be made of any suitable material and by any suitable method, with injection molding of plastic being most preferred. The preferred molded member 4 includes additional features for improving the use of the dispenser 2. For example, rounded corners at the transitions from one surface to another are preferred, including from a top surface at the top opening 34 of the connection portion cavity 32 to a front surface at the open side walls 28, 44 of the blade portion and connection portion cavities 16, 32 for ease of touch and from the front surface at the open side walls 28, 44 into the blade portion and connection portion cavities 16, 32 for ease of entry of the razor cartridge into the compartments 14.

The preferred embodiment further includes detents 74, preferably in the form of ribs in the blade portion cavity 16, to provide closer tolerances for holding the blade portion 10 of the razor cartridge 8 without excess play. Most preferably such detents are formed on the bottom wall 20 and front wall 24 of the blade portion cavity 16, as best seen in FIGS. 2-4, 6, 7 and 9). In this regard, the detents 74 help to ensure that the razor cartridge 8 is inserted and removed laterally through the open side walls 28, 44, especially when used in cooperation with the molded member 4 top surface that extends over the top of the razor cartridge 8 on the side corresponding to the closed side walls 26, 42.

The package member 6 can be made of any suitable material including heavy stock paper, plastic sheet material, plastic coated materials and the like. Most preferably, the package member 6 is formed of a heavy paper or plastic coated paper which is adhered to molded member 4 at the package front 62 and package bottom 4, but with the package back 66, package top 68 and flap 60 free to unfold so as to form the open configuration of the dispenser 2.

Variations, modifications and alterations to the preferred embodiment of the present invention described above will make themselves apparent to those skilled in the art. All such changes are intended to fall within the spirit and scope of the present invention, limited solely by the appended claims.

Any and all patents and/or patent applications referred to herein are hereby incorporated by reference.

We claim:

1. A razor cartridge dispenser for retaining and dispensing razor cartridges having a blade portion pivotably mounted to a connection portion, the connection portion including a mechanism for connecting the razor cartridge to a handle, the dispenser comprising:

a. a unitarily molded member for retaining, dispensing and accepting a plurality of individual razor cartridges, the molded member comprising a compartment for each of the individual razor cartridges in sequence, with each compartment comprising:

i. a blade portion cavity having an upper opening, a bottom wall, a top wall, a front wall, a closed side wall and an open side wall, wherein the top wall and bottom wall are substantially parallel to each other and the front wall is at a substantially right angle to the top and bottom walls and wherein a centerline between the parallel top and bottom walls in the direction of the upper opening is at an angle to the sequence of compartments;

ii. a connection portion cavity having a top opening, a bottom opening, a forward wall, a rearward wall, a closed side wall and an open side wall, the bottom opening of the connection portion cavity cooperating with the upper opening of the blade portion cavity;

iii. a cammed latch on a flexible arm for engaging the blade portion of the razor cartridge, said cammed latch and flexible arm forming a portion of the top wall of the blade portion cavity; and b. a package member providing a covering for the molded member, the package member comprising a reclosable flap for providing access to the razor cartridges in the compartments of the molded member.

2. The razor cartridge dispenser of claim 1 wherein the plurality of compartments comprises between two and six compartments.

3. The razor cartridge dispenser of claim 2 wherein the plurality of compartments comprises four compartments.

4. The razor cartridge dispenser of claim 1 wherein the blade portion and connection portion cavities are sized so as to permit entry and removal of the blade cartridges only through the open side walls.

5. The razor cartridge dispenser of claim 1 wherein the flexible arm on which the cammed latch is located extends along the top wall of the blade portion cavity on an axis from the closed side wall to the open side wall.

6. The razor cartridge dispenser of claim 1 wherein the blade portion cavity further comprises detents on one or more of the bottom wall, top wall and front wall.

7. The razor cartridge dispenser of claim 1 wherein the top opening of the connection portion cavity does not extend the full width of the blade portion cavity from the open side wall to the closed side wall.

8. The razor cartridge dispenser of claim 1 wherein the molded member further comprises a left side wall, a right side wall and a rear wall defining an upper perimeter about three sides of the molded member having a height just sufficient to extend above the uppermost elevation of the connection portions of the cartridges in the compartments.

9. The razor cartridge dispenser of claim 1 wherein the package member is formed of a continuous panel comprising a package front attached to a back of the molded member, a package bottom attached to a bottom of the molded member, a package back associated with a front of the molded member, a package top associated with the top of the molded member and a flap extending down a portion of the package front.

10. The razor cartridge dispenser of claim 9 wherein the package member further comprises flap corners connecting the package flap with the package top to maintain the package flap and package top in a substantially right angle.

11. The razor cartridge dispenser of claim 1 wherein the package member is made from a material taken from the group consisting of paper, heavy stock paper, plastic sheet material and plastic coated material.

12. The razor cartridge dispenser of claim 1 wherein the package member further comprises a catch to keep the dispenser in a closed orientation.

13. The razor cartridge dispenser of claim 9 wherein the package member further comprises a catch to keep the dispenser in a closed orientation, said catch comprising cooperating catch elements on an exterior of the package front and on an interior of the package flap.

14. The razor cartridge dispenser of claim 1 wherein the molded member further comprises rounded corners at the transitions from a front surface at the open side walls into the blade portion cavity and connection portion cavity for ease of entry of the razor cartridge into the compartments.

* * * * *